US007192565B2

(12) United States Patent
Briot et al.

(10) Patent No.: US 7,192,565 B2
(45) Date of Patent: Mar. 20, 2007

(54) METHOD OF COLLECTING MERCAPTANS CONTAINED IN A GASEOUS FEED

(75) Inventors: Patrick Briot, Pommier de Beaurepaire (FR); Renaud Cadours, Francheville (FR); Sophie Drozdz, Lyons (FR); Fabrice Lecomte, Paris (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 11/194,557

(22) Filed: Aug. 2, 2005

(65) Prior Publication Data

US 2006/0034742 A1 Feb. 16, 2006

(30) Foreign Application Priority Data

Aug. 2, 2004 (FR) ..... 04 08548

(51) Int. Cl.
*B01D 53/48* (2006.01)
*C01B 17/20* (2006.01)

(52) U.S. Cl. ..... 423/242.2; 423/245.1; 423/245.2; 208/189; 208/208 R; 208/219; 208/222; 208/223; 208/224; 48/127.3; 48/127.5; 48/127.7

(58) Field of Classification Search ..... 208/189, 208/208 R, 219, 222, 223, 224; 423/245.1, 423/245.2, 242.1, 242.2; 48/127.3, 127.5, 48/127.7

See application file for complete search history.

(56) References Cited

U.S. PATENT DOCUMENTS

| | | | | |
|---|---|---|---|---|
| 3,742,065 | A * | 6/1973 | Stoffer et al. | 568/60 |
| 4,459,205 | A | 7/1984 | Marty et al. | |
| 4,775,462 | A * | 10/1988 | Imai et al. | 208/189 |
| 5,463,134 | A * | 10/1995 | Frey | 568/59 |
| 6,231,752 | B1 * | 5/2001 | Putman | 208/213 |
| 6,440,299 | B2 * | 8/2002 | Hearn et al. | 208/189 |

FOREIGN PATENT DOCUMENTS

| | | |
|---|---|---|
| EP | 0 884 102 A1 | 12/1998 |
| WO | WO 02/34863 A1 | 5/2002 |

* cited by examiner

*Primary Examiner*—Timothy C. Vanoy
(74) *Attorney, Agent, or Firm*—Antonelli, Terry, Stout and Kraus, LLP.

(57) ABSTRACT

The gaseous feed flowing in through line 1 is contacted in contacting zone ZA with a liquid solvent flowing in through line 2. The solvent comprises between 0.001% and 100% by weight of a liquid olefin. Contacting in zone ZA is carried out in the presence of an acid catalyst. The purified gaseous feed is discharged from zone ZA through line 3. The sulfide-laden solvent is discharged through line 4, then regenerated in unit RE. The regenerated solvent is recycled through lines 7 and 2 to zone ZA.

11 Claims, 4 Drawing Sheets

METHOD OF COLLECTING MERCAPTANS CONTAINED IN A GASEOUS FEED

FIELD OF THE INVENTION

The present invention relates to a method of collecting and removing mercaptans present in a gaseous feed, notably in a hydrocarbon feed.

BACKGROUND OF THE INVENTION

Prior to being marketed, natural gas is subjected to three main operations: deacidizing, dehydration and gasoline extraction.

The purpose of the deacidizing operation is to remove the acid compounds such as carbon dioxide ($CO_2$), hydrogen sulfide ($H_2S$), carbonyl sulfide (COS) and mercaptans, mainly methylmercaptan, ethylmercaptan and propylmercaptans. The specifications generally allowed for deacidized gas are 2% $CO_2$, 4 ppm $H_2S$ and 20 to 50 ppm total sulfur content.

The dehydration operation then allows to control the water content of the deacidized gas in relation to transport specifications.

Finally, the gasoline extraction operation allows to guarantee the hydrocarbon dew point of the natural gas, also according to transport specifications.

The deacidizing operation, which is essentially intended to reduce the $CO_2$ and $H_2S$ content of the gas, is for example performed by means of an absorption method, using notably chemical solvents like, for example, alkanolamines such as diethanolamine (DEA) or methyldiethanolamine (MDEA). After this treatment, the gas meets the specifications relative to the $CO_2$ content, typically below 2% by mole, and to the $H_2S$ content, typically 4 ppm by mole. Part of the light mercaptans, notably methylmercaptan, is removed during this operation. The heavier mercaptans such as ethyl, propyl and butylmercaptan, or containing more than four carbon atoms, are not soluble enough in an aqueous solution or acid enough to significantly react with the alkanolamines generally used for deacidizing, and a large part thereof therefore remains in the gas. Most of these acid compound absorption methods have a mercaptan extraction efficiency ranging between 40% and 60%. Some technical solutions using solvents with a high physical absorption capacity such as water-alkanolamine-sulfolane mixtures, which achieve a 90% sulfur compound elimination but with a significant energy consumption, notably because of the high solvent flow rates required by such performances, can however be mentioned.

The dehydration operation can be carried out by means of a glycol process (for example the process described in document FR-2,740,468), using notably TEG, which allows to lower the water content of the gas down to a value close to 60 ppm by mole. The mercaptans are not eliminated in this stage. An adsorption method of T.S.A. (Thermal Swing Adsorption) type on molecular sieve, for example of 3A or 4A or 13X type, or on silica gel or alumina, can also be used. In this case, the water content of the gas is typically below 1 ppm by mole.

A last fractionation operation by cooling finally allows the treated gas to be separated into its different constituents so as to upgrade each cut produced: C1 cut, C2 cut, or C1+C2 cut, C3 cut, C4 cut, and heavier C5+ cut, possibly further separated into various complementary fractions. The major part of the sulfur compounds is concentrated in the liquid phases, which therefore have to be processed later to meet the sulfur specifications generally required.

It is therefore necessary to carry out one or more additional processing stages, depending on the distribution of the mercaptans in the various cuts obtained after fractionation. Generally, the mercaptans are removed from the liquid hydrocarbon cuts by caustic washing. Countercurrent contacting, in a plate column, of the hydrocarbon feed with a concentrated soda solution, between 10% and 20% by weight, provides elimination of all the sulfur compounds such as COS and the mercaptans. The mercaptans react with the soda and give mercaptides, which are then oxidized in the presence of a catalyst present in the solvent to give disulfides, while regenerating the caustic solution. The latter are then separated by decantation of the aqueous phase. The efficiency of this technique is furthermore closely linked with the nature of the mercaptans to be removed: it decreases as the number of carbon atoms of the hydrocarbon chain of the mercaptan increases. This can be explained by the low solubility in an aqueous solution of mercaptans having more than three carbon atoms.

An alternative to the caustic washing technique is the elimination of the mercaptans upstream from the fractionation stage. This complementary processing intended to lower the residual mercaptan proportion can consist of an adsorption stage using for example a 13X zeolite for desulfurization, the pore size of these zeolites allowing selective adsorption of the mercaptans. The methods used are then T.S.A. (Thermal Swing Adsorption) type processes wherein adsorption takes place at ambient or moderate temperature, typically ranging between 20° C. and 60° C., and high-temperature desorption, typically between 200° C. and 350° C., under sweeping of a purge gas, which can notably be part of the purified gas, generally between 5% and 20% of the flow of feed gas. The desorption gas containing a large amount of mercaptans then has to be treated prior to being recycled, for example by washing with a basic solution (soda or potash), with well-known limitations due to the low solubility of the mercaptans in an aqueous solution. The pressure is either maintained substantially constant throughout the cycle, or lowered during the regeneration stage so as to favour regeneration. At the outlet of this adsorption purification stage, the gas meets the total sulfur specifications.

The drawback of these adsorption sieves partly lies in the co-adsorption of water on the sieve. Furthermore, these methods are generally penalized by the production of a mercaptan-rich gaseous effluent which also has to be processed.

Besides, there are many methods for removing the mercaptans contained in a liquid hydrocarbon phase. Document U.S. Pat. No. 4,029,589 recommends to mix the hydrocarbon cut with halogenides (iodides, bromides . . . ) or complexing agents such as amines, carboxylic acids.

Documents U.S. Pat. No. 4,207,173 and U.S. Pat. No. 4,490,246 use a phthalocyanine-based catalyst in the presence of base and oxygen. The base used is tetra-alkylguanidine for converting the mercaptans to disulfides.

Similarly, document U.S. Pat. No. 4,383,916 uses an oxide catalyst in the presence of methanol for eliminating the mercaptans. Documents U.S. Pat. No. 4,459,205 and U.S. Pat. No. 4,466,906 use a metallic complex of polyaminoalkylpolycarboxylic acid deposited on an ion-exchange resin for converting the mercaptans to disulfides. Document U.S. Pat. No. 4,514,286 proposes using peroxides of hydroxide and cumene hydroperoxide type in the presence of amine.

Furthermore, document U.S. Pat. No. 4,794,097 discloses a method based on a catalyst obtained by combustion of wool on which cobalt phthalocyanine is deposited.

There are many techniques in this field, most of them based on oxidation of the mercaptans to disulfides according to the following reaction in the presence of a base:

$$R1SH+R2SH+\tfrac{1}{2}O_2 \rightarrow R1S—SR2+H_2O$$

where R1 and R2 are hydrocarbon chains.

The present invention provides a new technique for removing the mercaptans contained in a gaseous feed. In general terms, the mercaptan-laden gaseous effluent is contacted with a liquid feed containing olefins, in the presence of an acid catalyst. Under suitable conditions, the mercaptans are absorbed in the liquid feed and react with the olefins to form sulfides and not disulfides, soluble in the solvent. A solvent regeneration stage allows the collecting agent to be recycled.

SUMMARY OF THE INVENTION

In general terms, the present invention relates to a method of collecting the mercaptans contained in a gaseous feed, wherein the feed is contacted with a solvent comprising olefins and an acid catalyst so that the mercaptans are absorbed by the solvent and react with the olefins contained in the solvent to form sulfides, then the mercaptan-depleted gaseous feed is discharged.

According to the invention, the solvent is contacted with the feed at a relative pressure ranging between 1 bar and 200 bars, preferably between 5 bars and 150 bars, more preferably between 10 bars and 100 bars, and at a temperature ranging between 0° C. and 200° C., preferably between 20° C. and 150° C., more preferably between 40° C. and 120° C.

The catalyst can comprise at least one of the following compounds: phosphoric acid, sulfuric acid, boric acid, sulfonic acid, nitric acid, carboxylic acid, a faujasite, a mordenite, a zeolite, a fluorinated alumina, a chlorinated alumina, a natural clay, a synthetic clay.

The solvent can comprise between 0.001% and 100% olefins, preferably between 0.01% and 50%, the olefins comprising three to twenty carbon atoms, preferably between five and fifteen carbon atoms, more preferably between eight and fourteen carbon atoms, ideally between ten and twelve carbon atoms. The solvent can further comprise hydrocarbons with more than eight carbon atoms.

According to the invention, the sulfide-laden solvent can be discharged. The sulfide-laden solvent can be expanded so as to release elements co-absorbed upon contacting of the feed with the solvent. Furthermore, the sulfide-laden solvent can be distilled so as to release elements co-absorbed upon contacting of the feed with the solvent.

The sulfide-laden solvent can be incinerated.

The sulfide-laden solvent can be regenerated by hydrotreating, then at least part of the regenerated solvent is recycled by being contacted with the gaseous feed.

The sulfide-laden solvent can be regenerated by cracking, the solvent being contacted, at a temperature above 100° C., with an acid catalyst, then at least part of the regenerated solvent is recycled by contacting with the gaseous feed.

The method according to the invention allows a natural gas comprising mercaptans to be processed.

BRIEF DESCRIPTION OF THE FIGURES

Other features and advantages of the invention will be clear from reading the description hereafter, with reference to the accompanying figures wherein.

DETAILED DESCRIPTION

Figure 1:
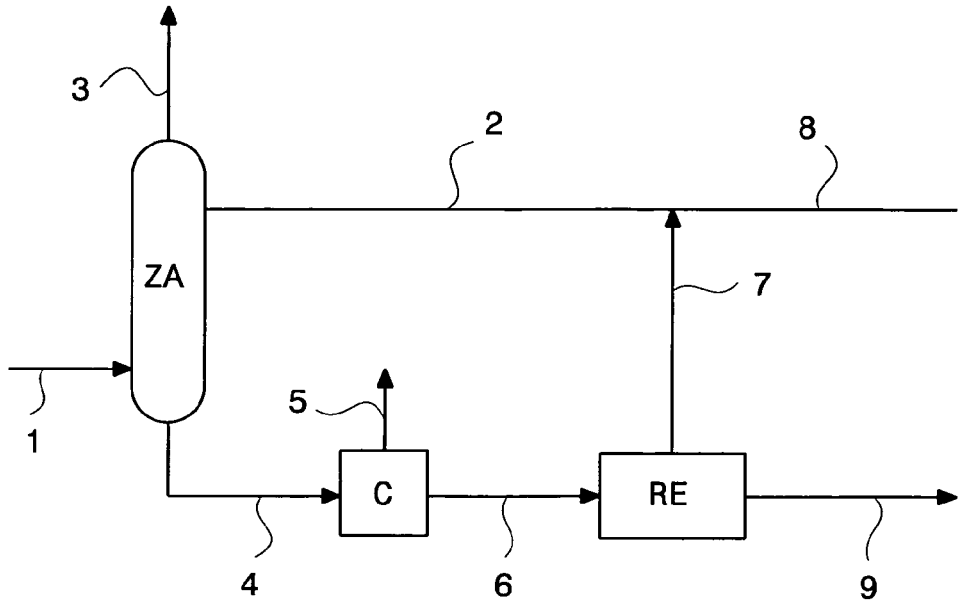
FIG. 1 diagrammatically shows the method according to the invention.

In FIG. 1, the gaseous feed to be processed flows in through line 1. The feed can comprise hydrocarbons having between one and ten carbon atoms, preferably between one and five carbon atoms. For example, the feed can directly come from a drilling site, this feed is then commonly referred to as straight-run or natural gas. This feed can also result from a separation process, for example from a distillation column or a gas-liquid separator or a sieve regeneration stage used for removing sulfur compounds from a natural gas feed, or from a conversion process, for example from a catalytic cracking unit or from a steam cracking unit.

The gaseous feed flowing in through line 1 is contacted in contacting zone ZA with a liquid solvent flowing in through line 2. The solvent comprises between 0.001% and 100% by weight of a liquid olefin having between three and twenty carbon atoms, preferably between five and fifteen carbon atoms. Contacting in zone ZA is carried out in the presence of an acid catalyst.

In zone ZA, the gaseous mercaptans are absorbed by the liquid solvent and react with the olefins in the presence of the acid catalyst so as to form a sulfide.

The chemical reaction carried out in zone ZA can be:

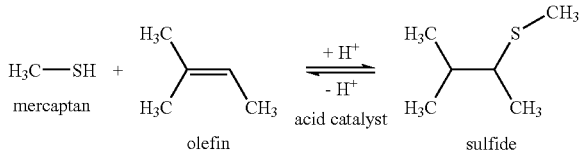

This addition reaction is not modified by the length of the alkyl chain of the mercaptan or the number of carbon atoms of the hydrocarbon chain of the olefin.

The sulfides formed solubilize in the liquid solvent, under suitable operating conditions. For example, according to the reaction described above, at atmospheric pressure, the methylmercaptan whose boiling point is 6.2° C. adds to methyl-2-butene-2 (boiling point 38.6° C.) so as to form a sulfide whose boiling point ranges between 130° C. and 140° C.

The purified gaseous feed, i.e. comprising no or little mercaptans, is discharged from zone ZA through line 3. The solvent laden with reaction product, i.e. sulfide, is discharged through line 4.

Gas-liquid contact between the mercaptan-laden gaseous feed and the olefin-containing liquid solvent, in the presence of a catalyst, simultaneously guarantees absorption of the mercaptan by the solvent and its reaction with the olefin present in this solvent. During contact, the mercaptans present in the gaseous feed solubilize in the solvent. The solubility of the mercaptan increases with its molecular mass, which allows to ensure elimination of the mercaptans comprising more than two carbon atoms, that are generally difficult to remove by means of the conventional caustic washing techniques used for processing liquid cuts from natural gas fractionation. The chemical reaction between the mercaptans and the olefin present in the solvent displaces the solubility equilibrium so as to absorb and to cause all the mercaptans present in the gaseous effluent to be desulfurized to react.

The acid catalyst allows to promote the addition reaction performed in zone ZA. The acid catalyst can consist of phosphoric, sulfuric, boric, sulfonic, nitric acids. These acids can come in liquid form in the aqueous phase or in form of ionic liquids or of molten salts. These acids can be supported on solid supports made of silica, alumina, or silica-alumina, or any other solid support. Acid catalysts such as natural or synthetic zeolites can also be used for implementing the present invention. By way of example, faujasites, mordenites, zeolites, X and Y for example, can be mentioned. Other acid solids can be used, such as fluorinated or chlorinated aluminas, natural or synthetic clays. Any catalyst form can be used for implementing the invention.

The acid catalyst can be in solution in the liquid solvent. The catalyst in solid form can be fixed to gas-liquid distribution elements of zone ZA (distribution plates, column packing) or it can be used as packing itself.

The olefins making up the liquid solvent comprise at least three carbon atoms. In order to limit losses by entrainment in the gaseous effluent, the olefins preferably have more than five carbon atoms, ideally more than eight. The olefins can be linear or branched. These olefins preferably have a single double bond. However, diolefins can be used if necessary rather than olefins. These olefins can be used pure, in admixture or diluted in a mixture of hydrocarbons having at least eight carbon atoms. Preferably, these hydrocarbons and the olefin used have a carbon chain of equal length, and the standard boiling-point temperatures of the former do not differ by more than 30° C. from that of the olefin.

The solvent flowing in through line 2 can come from processing and regeneration unit RE through line 7 and/or from an olefin reserve through line 8.

In zone ZA, gas-liquid contact is achieved under the thermodynamic conditions of availability of the gaseous effluent. In the case of a natural gas from a deacidizing unit, gas-liquid contacting can be carried out at a pressure ranging between 10 and 100 bars, and at a temperature ranging between 0° C. and 100° C., preferably between 20° C. and 60° C. Processing of other gaseous effluents such as synthesis gases can be performed under pressure conditions ranging between 1 and 100 bars, and temperatures ranging between 20° C. and 100° C.

Contact between the catalyst, the gaseous feed to be processed and the liquid solvent can be achieved in many ways.

Figure 2:
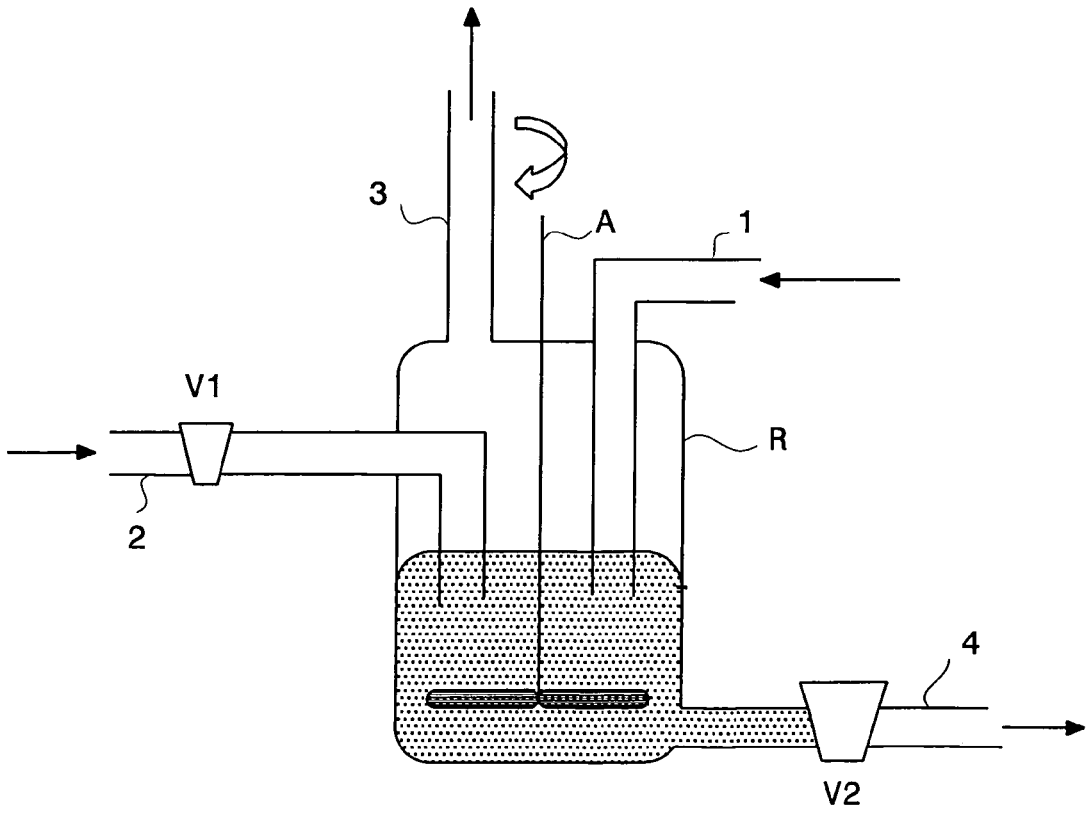
FIGS. 2 and 3 diagrammatically show gas-liquid contactors.

For example, zone ZA can be a reactor, shown in FIG. 2, perfectly stirred, containing the liquid solvent and the suspended catalyst. Reactor R of FIG. 2 is supplied with gaseous feed through line 1, and with solvent comprising olefins and an acid catalyst through line 2. Agitator A, a paddle agitator for example, allows the liquid content of reactor R to be stirred. The purified gaseous feed is discharged through line 3, the sulfide produced by the addition reaction between the mercaptans and the olefins, as well as the used catalyst, are discharged from reactor R through line 4. Delivery and discharge of the gaseous feed through lines 1 and 3 are performed continuously. Delivery and discharge of the solvent through lines 2 and 4 can be performed intermittently. Valve V1 allows an amount of solvent and of catalyst to flow into reactor R, valve V2 being closed. When reactor R contains the liquid solvent, a gaseous feed is purified until the solvent is spent, i.e. the mercaptans are no longer or hardly absorbed by the solvent. Valve V2 is then opened to discharge the used liquid solvent, i.e. comprising sulfide and the used catalyst, and it is replaced by fresh catalyst and solvent by opening valve V1.

Figure 3:
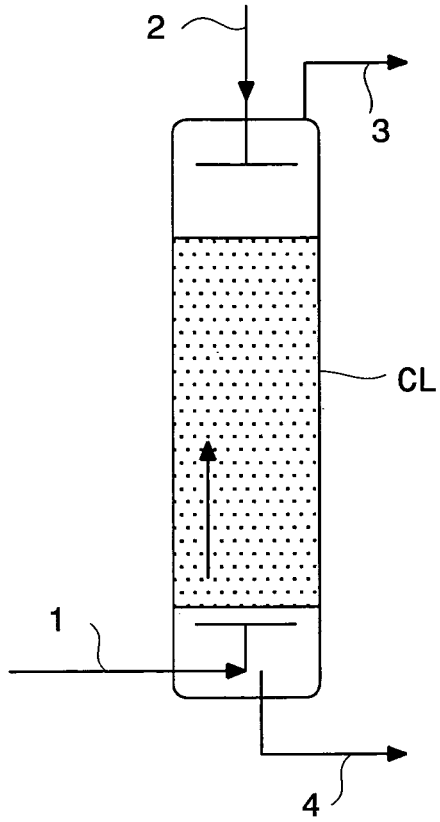

Zone ZA can also be a gas-liquid contactor of washing column CL type as shown in FIG. 3. In column CL of FIG. 3, the gaseous feed flowing in through line 1 circulates countercurrent to the solvent comprising olefins through line 2. The acid catalyst can be in solution in the solvent or fixed in solid form to elements interior to column CL. Column CL can also work in cocurrent mode, i.e. the liquid and the gas in contact circulate cocurrent to one another. The purified gaseous feed is discharged through line 3. The sulfide produced by the addition reaction between the mercaptans and the olefins is discharged from column CL through line 4.

Contacting in zone ZA can be carried out by means of any other equipment or technique known to the man skilled in the art.

Various known plate or packing geometries can be used. The contacting methods and the catalytic packings generally used in reactive distillation operations are suited to the invention. By way of example, we can mention the MULTIPAK or KATAPAK type catalytic packings described by Kolodziej et al. (Catalysis Today 2001, 69, p. 75). Alternatively, it is also possible to use monolith packings insofar as the flow rates of the phases to be contacted can be adjusted in order to reach in the channels the Taylor flow regime for which transfer of the mercaptans from the gas phase to be processed to the solvent is optimized.

The chemical reaction between the mercaptans and the olefins being a balanced reaction, control of the mercaptan content of the treated gaseous effluent allows to control the efficiency of the mercaptan collection by the olefins. A detector for measuring the mercaptan content in the purified gaseous feed discharged through line 3 can be installed, for example in zone ZA or on line 3. The operating conditions in zone ZA can be modified according to the measured mercaptan content, for example the solvent or gaseous feed flow rate can be adjusted, or the amount of catalyst, the pressure and temperature conditions can be changed in order to best achieve the addition reaction of the mercaptans with the olefins.

The method allows to convert mercaptans (gaseous and toxic compounds) to sulfides (non-toxic liquid compounds). The used solvent thus obtained through line 4 can be processed in different ways according to the production site availabilities. If the size of the site (offshore platform) does not allow processing on the spot, the solvent can be readily transported in barrels by ship to a reprocessing site.

In FIG. 1, the used solvent discharged through line 4 can first be subjected to a sulfide concentration operation in unit C. Unit C performs expansion of the solvent, for example through an expansion valve or turbine. In place of or in addition to expansion, the used solvent can be subjected to distillation. The pressure decrease and/or distillation are achieved so as to release the various elements co-absorbed in the solvent upon contacting in zone ZA. The hydrocarbons comprising less than three carbon atoms are essentially released.

For example, expansion is carried out in one or two flash drums, at pressures ranging between 10 bars and 70 bars.

Figure 4:
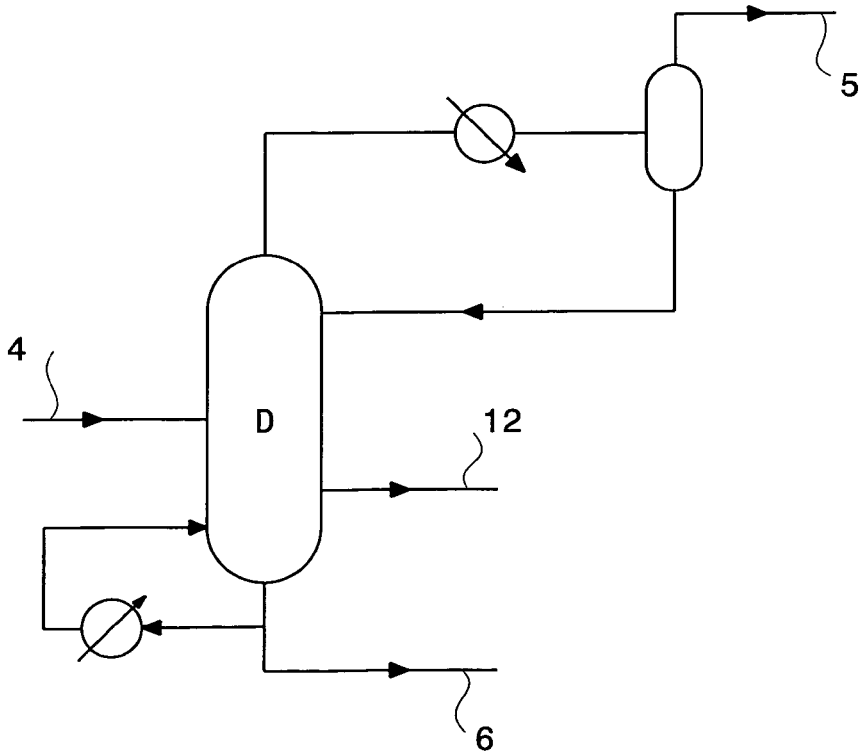
FIG. 4 diagrammatically shows a distillation device.

The distillation stage allows to concentrate at the column bottom the sulfides whose boiling-point temperature is higher than that of the other constituents of the used solvent. Distillation can be performed according to the process diagrammatically shown in FIG. 4. The used solvent flowing in through line 4 (this solvent may have been first subjected to one or more expansions) is fed into distillation column D. The gaseous fraction discharged at the top of column D is partly condensed to form a reflux introduced at the top of column D, the rest of the gaseous fraction being discharged through line 5. The sulfides concentrated at the bottom of column D are discharged through line 6. At an intermediate level between the bottom and the top of column D, an olefin-rich and sulfide-depleted liquid can be separated and discharged through line 12. This liquid can be recycled to zone ZA to be contacted with the gaseous feed flowing in through line 1.

The elements released in gaseous form in unit C are discharged through line 5.

During the regeneration stage as described above, contacting the olefin-rich solvent with a catalyst of acid nature at high temperature can lead to an olefin loss due to an oligomerization reaction of these compounds. The fraction of olefins lost by oligomerization depends on the temperature conditions of the cracking section, on the nature of the catalyst, on the residence time of the olefins in this section, and therefore on the technology chosen for this section.

These oligomers are characterized by a higher boiling-point temperature than that of the other solvent compounds, i.e. mainly the olefins selected for collecting the mercaptans or the sulfides formed during the reaction in zone ZA, or possibly the hydrocarbons co-absorbed in ZA if section C is not used.

Separation of these oligomers can be achieved by distillation of the effluent from regeneration section RE. The operation can be carried out on all of the solvent recycled through line 7. It is preferably performed on a fraction of the stream taken from line 7.

During distillation, the compounds resulting from the oligomerization reaction and the sulfides that have not been cracked in RE concentrate at the bottom of the distillation column. The olefin-containing solvent is recovered at the top of the column and recycled to section ZA. The temperature and pressure conditions in this column are conditioned by the nature of the solvent and of the olefin used in the method.

Various by-products resulting from side reactions such as the oligomerization reactions can lead to the formation of heavy compounds. These reactions can occur in section ZA but they generally remain trivial because they are favoured by temperature. A solvent regeneration approach by thermal equilibrium displacement could favour these reactions. According to the installation configuration, these heavy products can accumulate in the solvent. In the case of the distillation of the solvent from section ZA described above, these heavy products are concentrated at the bottom of distillation column D and discharged with the sulfides.

The solvent processed in unit C is discharged through line 6 to be fed into regeneration or processing zone RE. In zone RE, various techniques can be used for processing or regenerating the used solvent.

For example, in zone RE, the used solvent flowing in through line 6 can be incinerated in refinery heaters. Thus, the sulfides are converted to sulfur oxides which are eliminated from the fumes through various conventional means.

Figure 5:
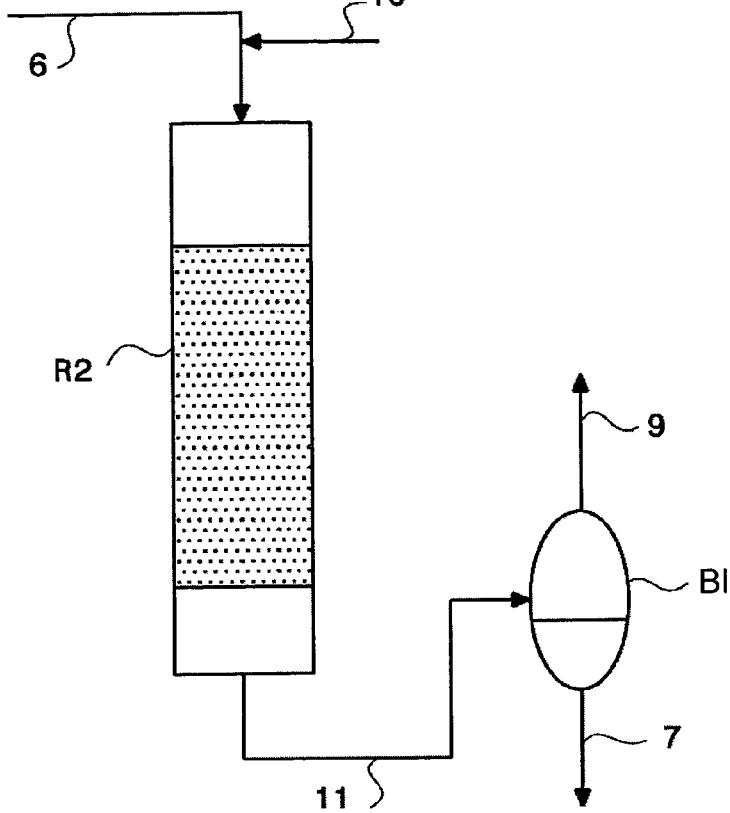
FIG. 5 diagrammatically shows a hydrotreating process.

Alternatively, zone RE can use a hydrotreating process diagrammatically shown in FIG. 5. The used solvent can be hydrogenated if the (production or reprocessing) site is provided with a source of hydrogen.

The hydrotreating process diagrammatically shown in FIG. 5 is well-known to the man skilled in the art: the used solvent flowing in through line 6 is mixed with hydrogen flowing in through line 10, then the mixture is contacted with a catalyst in reactor R2. The hydrogen is fed into the solvent at a pressure ranging between 5 bars and 100 bars, preferably between 5 bars and 50 bars, and more preferably between 5 bars and 30 bars. The ratio of the volume flow rate of the mixture of solvent and hydrogen to the volume of catalyst ranges between 0.01 $m^3/m^3/h$ and 20 $m^3/m^3/h$, preferably between 0.1 $m^3/m^3/h$ and 10 $m^3/m^3/h$. The temperature of the catalyst in reactor R2 ranges between 100° C. and 400° C., preferably between 150° C. and 300° C. The type of catalyst used can be a catalyst comprising nickel or molybdenum or cobalt, or a mixture of these various metals in their sulfide forms. These sulfides are supported on alumina, silica or silica-alumina, or any other amorphous support, clay for example.

The reaction products obtained in line 11 at the outlet of reactor R2 are:

a gaseous fraction containing the hydrogen that has not been consumed by the reaction, hydrogen sulfide ($H_2S$), and light alkanes from the decomposition of the sulfides. For example, the sulfide resulting from the addition of methylmercaptan is hydrogenated to $H_2S$, methane and alkane corresponding to the olefin used, a liquid fraction corresponding to the initial solvent used and to the product resulting from the hydrogenation of the olefin used during the addition stage.

The liquid and gaseous fractions are separated in drum B1. The gaseous fraction is discharged through line 9. The liquid fraction is discharged through line 7, and it can be recycled by being sent through line 2 to zone ZA. Preferably, only part of the liquid fraction is discharged through line 7 to be recycled to zone ZA through line 2, the other part being ejected. An olefin supply through line 8 to zone ZA allows part of the olefin to be regularly replaced.

Figure 6:
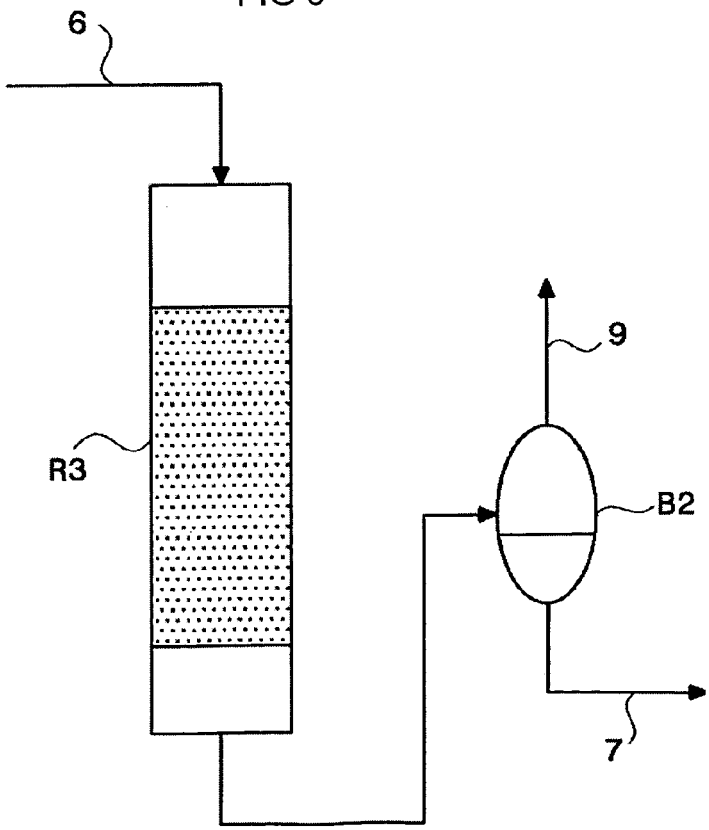
FIGS. 6 and 7 diagrammatically show cracking processes.

Alternatively, zone RE can use a sulfide cracking operation, this operation being diagrammatically shown in FIG. 6.

The used solvent flowing in through line 6 is contacted with an acid catalyst in reactor R3 at high temperature, for example at a temperature above 100° C. Reactor R3 can be heated and/or the used solvent can be heated prior to being fed into reactor R3.

The catalyst can consist of phosphoric, sulfuric, boric, sulfonic, nitric acids. These acids can come in form of ionic liquids or of molten salts. These acids can be supported on solid supports such as silicas, aluminas, or silica-aluminas, or any other solid support. Acid catalysts such as natural or synthetic zeolites can be used. By way of example, faujasites, mordenites, X and Y zeolites can be mentioned. Other acid solids can be used, such as fluorinated or chlorinated aluminas, natural or synthetic clays. The solid catalyst can have any geometrical shape.

The temperature in cracking reactor R3 can range between 100° C. and 500° C., preferably between 120° C. and 400° C., and more preferably between 150° C. and 350° C. The ratio of the volume flow rate of feed flowing in through line 6 to the volume of catalyst in reactor R3 ranges between 0.01 $m^3/m^3/h$ and 20 $m^3/m^3/h$, preferably between 0.1 $m^3/m^3/h$ and 10 $m^3/m^3/h$. The pressure in reactor R3 is so adjusted that the feed is at the minimum 60% in the liquid phase at the catalytic zone inlet, and preferably 90% in the liquid phase.

The cracking operation generates two fractions that are separated in drum B2:

- a gaseous fraction containing all the mercaptans initially present in the natural gas. These mercaptans discharged through line 9 can be burnt with part of the gases in the furnaces of the site and converted to sulfur oxides, or processed in a Claus plant,
- a liquid fraction consisting of the solvent comprising the regenerated olefin that can be recycled to the mercaptan removal unit through lines 7 and 2.

Figure 7:
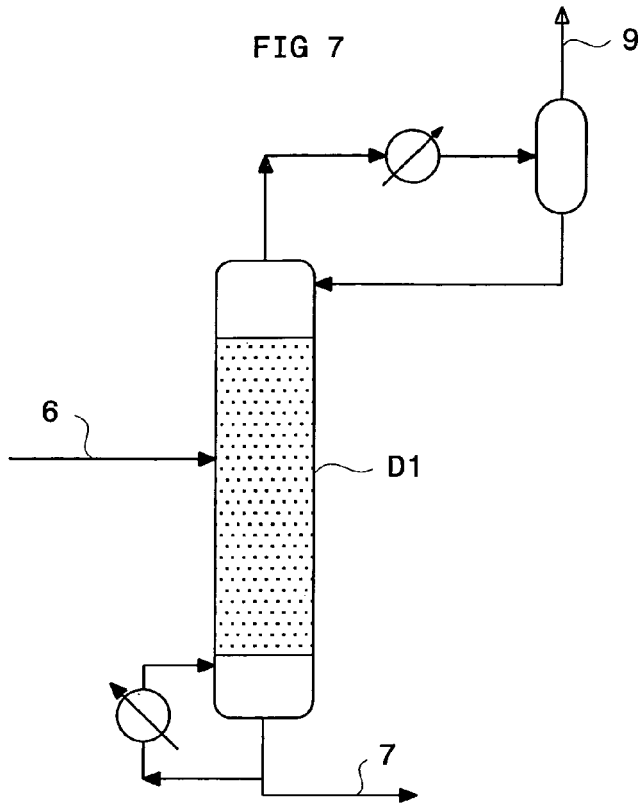

The cracking operation in zone RE can be carried out by means of a distillation operation diagrammatically shown in FIG. 7. The used solvent flowing in through line 6 is fed into distillation column D1, in the presence of the acid catalyst. The catalyst can be fed into column D1 with the solvent through line 6. The catalyst can also be fixed in solid form to elements interior to column D1. The reaction between the olefin and the mercaptans being governed by a thermodynamic equilibrium, high-temperature distillation, between 100° C. and 200° C., ideally between 120° C. and 140° C., allows to regenerate the olefin and to reform the mercaptan. The olefin in liquid phase is recovered at the bottom of distillation column D1 through line 7 then, possibly after cooling, it is sent back through line 2 to contacting zone ZA. The mercaptans and possibly the $H_2S$ co-absorbed in the absorption stage are discharged in the gas phase at the top of column D1 through line 9. In order to facilitate extraction of the mercaptans, an entrainment commonly referred to as stripping can be achieved by feeding an inert gas or possibly part of the processed natural gas into column D1. This stripping gas can be obtained upon desorption of the compounds co-absorbed in unit C.

Figure 8:
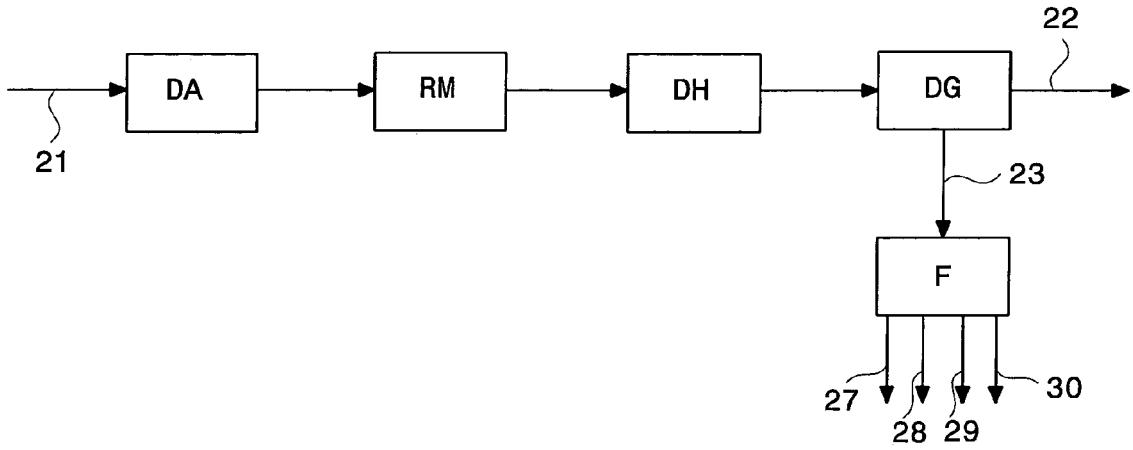
FIG. 8 shows a natural gas processing chain.

The mercaptan collection method according to the invention can be used in a natural gas processing chain. In FIG. 8, the unprocessed natural gas flows in through line 21 to be fed into deacidizing unit DA. The deacidized natural gas is subjected in unit RM to the mercaptan collection process described in connection with FIG. 1. Then, the natural gas coming from unit RM is dehydrated in unit DH, and then gasoline extraction is performed in unit DG. The methane and possibly ethane cut is discharged through line 22. The hydrocarbons heavier than methane are discharged from unit DG through line 23 to be fractionated in unit F into various upgradable hydrocarbon cuts, for example a propane cut, a butane cut and a cut comprising the pentanes and the heavier hydrocarbons.

Alternatively, mercaptan removal unit RM can be arranged downstream from dehydration unit DH. In this case, the natural gas is subjected, in order, to the following treatments: deacidizing, dehydration, mercaptan removal and gasoline extraction.

The examples given hereafter are intended to illustrate the invention but they are in no way limitative. These examples show that the present invention allows to remove the mercaptans from a gaseous cut, that this method works whatever the length of the alkyl chain, and that it is definitely possible to regenerate the solvent under suitable conditions.

EXAMPLE 1

Elimination of Methylmercaptan (Batch System)

The experiment was carried out using a reactor as shown in FIG. 2. A feed of solvent containing an olefin, 1-dodecene, is fed into reactor R. An amount of acid catalyst, 14% by mass in relation to the solvent, is then fed into the reactor. This catalyst is a sulfonic resin marketed under reference Amberlyst 15 by the Rohm & Haas company. Stirring provides fluidization of the catalyst bed during this test. Line 1 allows to contact a gaseous effluent to be processed with the solvent. A gaseous effluent flow rate of 10 Normal 1/h containing 2000 ppm methylmercaptan is imposed. During this experiment, olefin renewal valve V1 and sulfide-saturated solution discharge valve V2 are closed. Upon contact at ambient temperature, the mercaptan contained in the gaseous effluent is absorbed by the solvent and reacts with the 1-dodecene in the presence of the solid acid catalyst. Analysis of the gaseous effluent leaving reactor R through line 3 allows to measure the efficiency of the invention. The mercaptan elimination efficiency is above 90% during the first hour. Saturation of the solvent, easily explained by the exhaustion of the olefin, is then observed.

EXAMPLE 2

Elimination of Methylmercaptan (Continuous System)

A second experiment was carried out with the same experimental device as in example 1, i.e. the reactor of FIG. 2. However, in example 2, renewal of the solvent is performed in reactor R. The experiment is first carried out according to the protocol described in example 1. When the mercaptan elimination rate eventually decreases as a result of the solvent saturation (below 70% elimination), makeup solvent is supplied in reactor R through line 2. Discharge through bottom valve V2 allows partial elimination of the used solvent and allows to keep the volume of solvent in reactor R constant. The supply of clean solvent allows to maintain a methylmercaptan elimination efficiency above 90%. Various operating parameters such as the gas flow rate, the solvent flow rate, the proportion of catalyst in the system were examined to test the efficiency of the method.

EXAMPLE 3

Regeneration of the Olefin

The reaction being balanced, example 3 was carried out to show the regenerability of the solvent. The used solvent, i.e. laden with sulfides from the methylmercaptan and dodecene reaction, is fed with the catalyst into a drum. The used solvent is obtained upon stabilization of the system described in example 1. Heating to 100° C. of the used solvent in the drum leads to invert the reaction and to reform the methylmercaptan which desorbs solvent. The temperature rise up to 120° C. allows to facilitate regeneration of the solvent. 90% of the sulfur compounds present in the solvent are eliminated in gaseous form during this test.

EXAMPLE 4

Elimination of Butylmercaptan with an Olefin Having Five Carbon Atoms

The experimental device used in this example is substantially identical to washing column CL of FIG. 3, but with cocurrent injection of the solvent and of the gas comprising the mercaptans. The solvent used consists of 50% by weight of n-pentane and 50% by weight of methyl-2 butene-2. A previously heated inert gas (nitrogen) containing 2000 ppm n-butylmercaptan is injected. The catalyst contained in the column is identical to the catalyst used in example 1. The operating conditions are as follows:

pressure in the column: 10 bars
temperature in the column: 50° C.
volume flow rate of solvent in relation to volume of catalyst LHSV: 1 l/l/h.

Under such conditions, the butylmercaptan elimination is about 99%.

EXAMPLE 5

Elimination of Butylmercaptan with an Olefin Comprising Eight Carbon Atoms

The experimental device used in this example is substantially identical to the washing column of FIG. 3, but with cocurrent injection of the solvent and of the mercaptan-containing gas. The solvent used consists of 50% by weight of n-pentane and 50% by weight of the mixture of trimethyl-2,4,4 pentene-1 and of trimethyl-2,4,4 pentene-2 commonly referred to as diisobutenes. Nitrogen that has first been heated and containing 2000 ppm n-butylmercaptan is injected. The catalyst contained in the column is identical to the catalyst used in example 1. The operating conditions are as follows:
pressure in the column: 10 bars
temperature in the column: 50° C.
LHSV: 1 l/l/h.

Under such conditions, the butylmercaptan elimination is about 93%.

The experimentation was continued in order to examine the stability of this system. The results of the butylmercaptan elimination as a function of time are given in the table hereafter:

| Time (hours) | Butylmercaptan elimination (%) |
|---|---|
| 0 | |
| 2.4 | 93 |
| 11.4 | 96.5 |
| 14.4 | 95.9 |
| 70.5 | 97.9 |
| 116 | 97.3 |

Consequently, example 5 shows that the catalyst is not deactivated in the course of time. This allows the mercaptans to be eliminated in a stable and efficient manner in the course of time.

The invention claimed is:

1. A method of collecting the mercaptans contained in a gaseous feed, wherein the feed is contacted with a solvent comprising olefins and an acid catalyst so that the mercaptans are absorbed by the solvent and react with the olefins contained in the solvent to form sulfides, then the mercaptan-depleted gaseous feed is discharged, wherein the sulfide-laden solvent is discharged and is expanded so as to release elements co-absorbed during contacting of the feed with the solvent.

2. A method as claimed in claim 1, wherein the solvent is contacted with the feed at a relative pressure ranging between 1 bar and 200 bars, and at a temperature ranging between 0° C. and 200° C.

3. A method as claimed in claim 1, wherein the catalyst comprises at least one of the following compounds: phosphoric acid, sulfuric acid, boric acid, sulfonic acid, nitric acid, carboxylic acid, a faujasite, a mordenite, a zeolite, a fluorinated alumina, a chlorinated alumina, a natural clay, a synthetic clay.

4. A method as claimed in claim 1, wherein the solvent comprises between 0.001% and 100% olefins having three to twenty carbon atoms.

5. A method as claimed in claim 4, wherein the solvent further comprises hydrocarbons having more than eight carbon atoms.

6. A method as claimed in claim 1, wherein the sulfide-laden solvent is also distilled so as to release elements co-absorbed during contacting of the feed with the solvent.

7. A method as claimed in claim 1, wherein the sulfide-laden solvent is incinerated after being expanded.

8. A method as claimed in claim 1, wherein the sulfide-laden solvent is regenerated by hydrotreating, then at least part of the regenerated solvent is recycled by being contacted with the gaseous feed.

9. A method as claimed in claim 8, wherein part of the regenerated solvent is distilled so as to separate the oligomers from the regenerated solvent.

10. A method as claimed in claim 1, wherein the sulfide-laden solvent is regenerated by cracking, the solvent being contacted, at a temperature above 100° C., with an acid catalyst, then at least part of the regenerated solvent is recycled by being contacted with the gaseous feed.

11. A method as claimed in claim 1, wherein the gaseous feed is a natural gas comprising mercaptans.

* * * * *